US007690631B2

(12) United States Patent
Rathjen

(10) Patent No.: US 7,690,631 B2
(45) Date of Patent: Apr. 6, 2010

(54) SKI HOLDER FOR TUNING SKIS

(76) Inventor: Scott Rathjen, 19 Jonathan Ct., Warwick, NY (US) 10990

( * ) Notice: Subject to any disclaimer, the term of this patent is extended or adjusted under 35 U.S.C. 154(b) by 0 days.

(21) Appl. No.: 11/818,653

(22) Filed: Jun. 15, 2007

(65) Prior Publication Data

US 2008/0006978 A1 Jan. 10, 2008

Related U.S. Application Data

(60) Provisional application No. 60/813,886, filed on Jun. 15, 2006.

(51) Int. Cl.
*B23Q 3/00* (2006.01)

(52) U.S. Cl. ..... 269/296; 269/289 R; 269/307

(58) Field of Classification Search ..... 269/43, 269/45, 296, 275, 131, 268, 906, 289 R, 42, 269/307

See application file for complete search history.

(56) References Cited

U.S. PATENT DOCUMENTS 1,816,723 A * 7/1931 Dunoyer ..... 269/131
2,431,589 A * 11/1947 Shuler, Jr. ..... 414/607
2,468,358 A * 4/1949 Clark ..... 408/95
5,566,931 A * 10/1996 Considine ..... 269/111
6,367,788 B1 * 4/2002 Babchuk ..... 269/45
2006/0043662 A1 * 3/2006 Blake ..... 269/249
2008/0006978 A1 * 1/2008 Rathjen ..... 269/296

OTHER PUBLICATIONS

Product Details for Parts #MT3400 and #MT603—FK Tools Ski & Snowboarding Tuning Tools, Waxes and Accessories webpage printouts (2005) (retrieved from http://www.archive.org/) (3 pages).
Toko.ch/Products. Tools Alpine/Snowboard—Fixation: Ski Vise Easy webpage printout from http://www.toko.ch/toko/katalog.asp?view=detail&did=93&dart=4&tid=253417&sid=2 (2006) (2 pages).
Ski Man—High Tech Ski & Snowboard Tuning Tools webpage printout (2005) (retrieved from http://www.archive.org/) (1 page).

* cited by examiner

*Primary Examiner*—Lee D Wilson
(74) *Attorney, Agent, or Firm*—McCarter & English, LLP

(57) ABSTRACT

A ski holder for tuning skis is disclosed. The device allows a ski to be held in a variety of orientations so that adjustments and maintenance work can be performed thereon. The device includes a track assembly, a plurality of ski support assemblies slidably engageable with the track assembly, and a plurality of binding support assemblies slidably engageable with the track assembly. The ski support assemblies allow a ski to be held in vertical, horizontal, and angled positions, and can be locked in desired positions along the track assembly. The binding support assemblies contact bindings of a ski to assist with retaining a ski on the holder, and can also be locked in desired positions along the track assembly.

13 Claims, 9 Drawing Sheets

SKI HOLDER FOR TUNING SKIS

RELATED APPLICATIONS

The present application claims the benefit of U.S. Provisional Application Ser. No. 60/813,886 filed Jun. 15, 2006, the disclosure of which is expressly incorporated herein by reference in its entirety.

BACKGROUND OF THE INVENTION

1. Field of the Invention

The present invention relates to equipment for servicing skis, and more particularly, to a ski holder for tuning skis.

2. Related Art

In the sport of skiing, it is often necessary to adjust and maintain ("tune") ski equipment. In large part, such maintenance is required as a result of mechanical stress and wear to skis which occurs over time. For example, ski edges become dull over time and require sharpening to maintain optimal performance. Similarly, ski bottoms can become scraped and gauged, and it is desirable to periodically restore them to smooth surfaces.

To adjust and maintain skis, it is necessary to properly support a ski while work is being performed. Specifically, it is important for a ski to be easily engaged by the support and held firmly in place when maintenance work is being performed, particularly when a ski is being sharpened. Unfortunately, existing ski support systems do not adequately accommodate a wide variety of ski shapes, sizes, and designs, while firmly supporting skis and while allowing for easy engagement by the support.

Accordingly, what would be desirable, but has not yet been provided, is a ski holder which addresses the foregoing limitations of existing ski support systems.

SUMMARY OF THE INVENTION

The present invention relates to a ski holder for tuning skis. The device allows a ski to be held in a variety of orientations so that adjustments and maintenance work can be performed on a ski. The device includes a track assembly, a plurality of ski support assemblies slideably engageable with the track assembly, and a plurality of binding support assemblies slideably engageable with the track assembly. The support assemblies allow skis of different shapes, sizes, and designs to be held and supported. The ski support assemblies allow a ski to be held in vertical, horizontal, and angled positions, and can be locked in desired positions along the track assembly. The binding support assemblies contact bindings of a ski to assist with retaining the ski on the ski holder, and can also be locked in desired positions along the track assembly. The device can be disassembled to allow for storage and/or transportation of the device.

BRIEF DESCRIPTION OF THE DRAWINGS

The foregoing features of the invention will be apparent from the following Detailed Description of the Invention, taken in connection with the accompanying drawings, in which.

DETAILED DESCRIPTION OF THE INVENTION

The present invention relates to a ski holder which allows a ski to be held in a variety of orientations so that adjustments and maintenance work can be performed on a ski. The device includes a track assembly, a plurality of ski support assemblies slidably engageable with the track assembly, and a plurality of binding support assemblies slidably engageable with the track assembly. The ski support assemblies allow a ski to be held in vertical, horizontal, and angled positions, and can be locked in desired positions along the track assembly. The binding support assemblies contact bindings of a ski to assist with retaining the ski on the ski holder, and can also be locked in desired positions along the track assembly.

Figure 1:
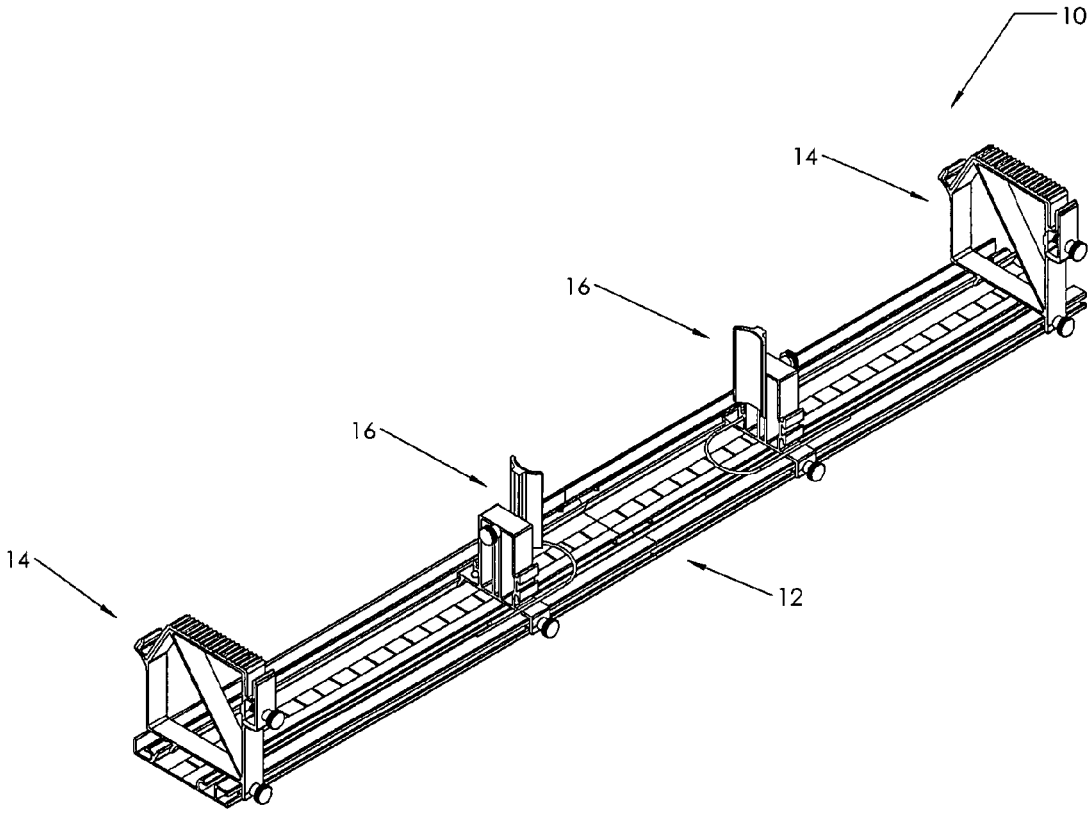
FIG. 1 is a perspective view of the ski holder of the present invention.

FIG. 1 is a perspective view showing the ski holder of the present invention, indicated generally at 10. The device 10 includes a track assembly 12, ski support assemblies 14, and binding support assemblies 16. The support assemblies 14, 16 are slideably engageable with the track assembly 12, and can be locked at any desired position along the track assembly 12. Advantageously, this allows the device 10 to support and hold skis of various shapes, sizes, and designs. The ski support assemblies 14 support and hold a ski, and the binding support assemblies 16 contact bindings of a ski to assist with retaining the ski on the device 10. The support assemblies 14, 16 can be moved along the track assembly 12, or removed from the track assembly 12 as desired, and the track assembly 12 can be disassembled so that the device 10 can be easily shipped, stored, and/or transported. The track assembly 12, ski support assemblies 14, and binding support assemblies 16 could be manufactured from any suitable material, such as metal (e.g., aluminum, etc.), plastic, or any other suitable material, using any suitable manufacturing technique such as machining, casting, molding, extrusion, etc.

Figure 2:
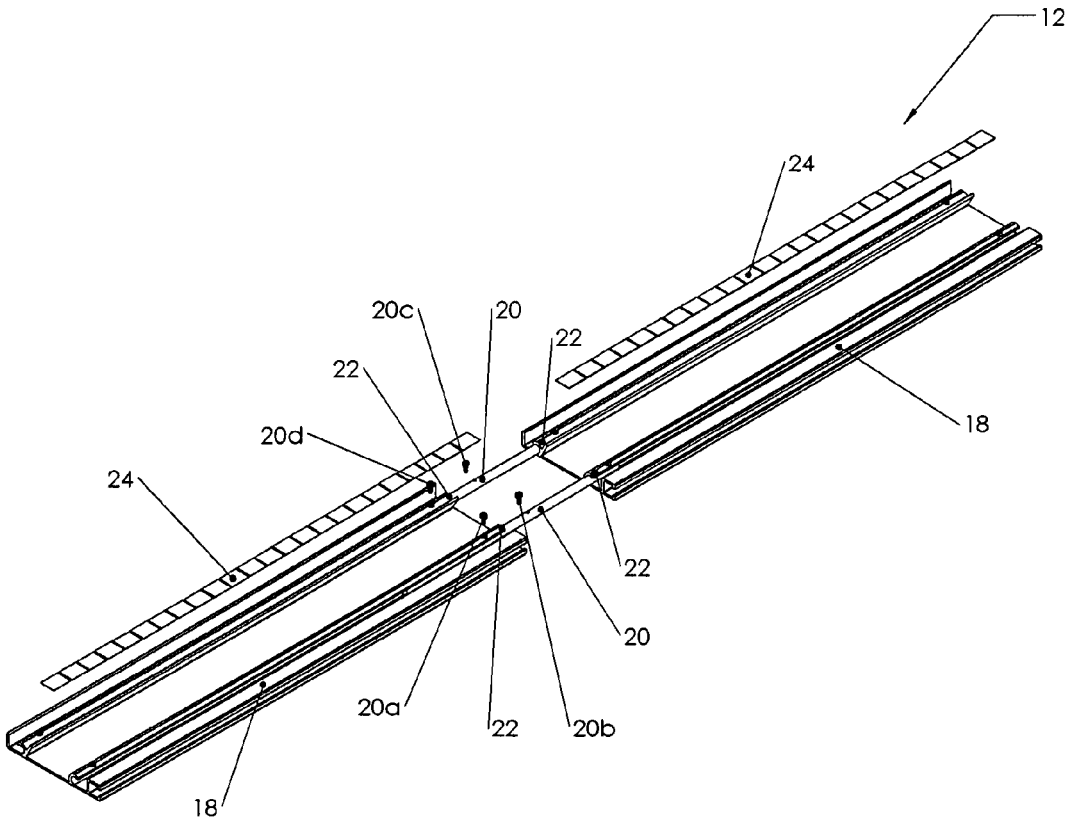
FIG. 2 is an exploded perspective view showing the track assembly of the present invention in greater detail.

FIG. 2 is an exploded perspective view showing the track assembly 12 in greater detail. The track assembly 12 includes track portions 18 which can be interconnected by connecting rods or pins 20. Each track portion 18 includes apertures 22 which receive and frictionally engage the rods 20 to interconnect the track portions 18. Optionally, the rods 20 may be held securely in place with screws 20*a*-20*d* or other suitable device. As can be appreciated, any desired number of track portions 18 can be interconnected to provide a track having a desired length. Additionally, the track sections 18 may be positioned at different locations on the rods 20 to adjust the length of the track assembly 12. Optionally, each track portion 18 could include a scale 24 for indicating the positions of the support assemblies 14, 16 and/or the distances between such assemblies.

Figure 3:
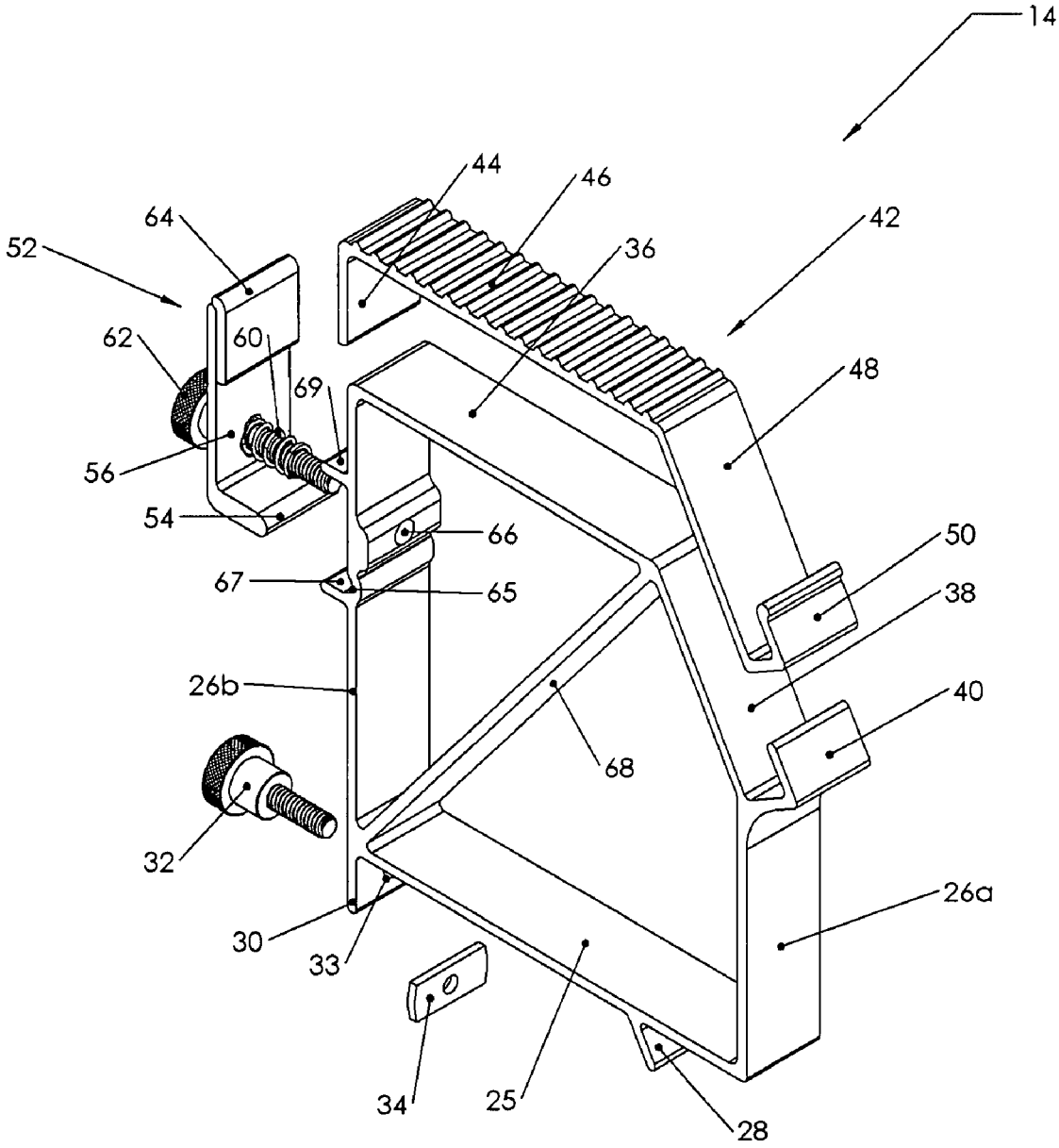
FIG. 3 is an exploded perspective view showing the ski support assembly of the present invention in greater detail.

FIG. 3 is an exploded perspective view showing the ski support assembly 14 of the present invention in greater detail. Each support assembly 14 includes a transverse bottom wall 25, a pair of upright walls 26*a* and 26*b* interconnected with the bottom wall 25, an angled wall 38 interconnected with the upright wall 26*a*, and a transverse upper wall 36 interconnecting the upright wall 26*b* and the angled wall 38. A cross-member 68 could be included to provide additional strength for the support assembly 14. Any desired number of cross-members could be provided for additional strength.

A depending track engagement projection 28 and a depending track guide tab 30 are provided on the bottom wall 25 to facilitate slideable engagement between the ski support assembly 14 and the track assembly 12, as will be discussed. The tab 30 includes an aperture 33 which receives a set screw 32 that extends into a channel along an edge of the track assembly 12 for selectively locking the support assembly 14 in a desired position along the track assembly 12. A nut 34 positioned within the channel threadably engages the set screw 32 and bears against the track assembly 12 to hold the support assembly 14 in a fixed position when the set screw 32 is tightened by a user. The depending track engagement projection 28 could be angled with respect to the bottom wall 25, as shown, slides along a corresponding channel formed in the track assembly 12, and is shaped so as to prevent the support assembly 14 from detaching from the track assembly 12 when slideably engaged therewith. These features work together to limit the relative movement of the support assembly 14 with respect to the track assembly 12 during use.

The transverse upper wall 36 of the support assembly 14 provides a surface against which a ski can be placed in a horizontal position. Additionally, the angled wall 38 provides a surface against which a ski can be placed in an angled position. A support finger 40 is provided at the lower end of the angled wall 38 and includes a bearing surface and retaining surfaces at right angles to each other for receiving a side of a ski to support a ski against the angled wall 38. An angled cushion 42, which includes an upright portion 44, a transverse portion 46, an angled portion 48, and a finger portion 50, is attached to the support assembly 14 for contacting a ski and to prevent damage to the ski when the ski is being held by the present invention. The cushion 42 need not be provided in one piece, e.g., a plurality of separate cushions could be provided for covering the surfaces shown in FIG. 3. The cushion 42 provides non-slip surfaces to reduce the possibility that a ski will move or slip off of the support assembly 14 during use.

The support assembly 14 includes a clamp assembly 52 for holding a ski in a generally vertical position. The clamp assembly 52 includes a rounded bottom projection 54, an upright wall 56, a set screw 62, and a biasing spring 60 disposed coaxially about the set screw 62. The set screw 62 threadably engages threaded aperture 66 in upright wall 26*b*. When the set screw 62 is tightened by a user, the clamp assembly 52 is drawn toward the upright wall 26*b* of the support assembly 14 to provide a clamping action for holding a ski in a vertical orientation. A transverse projection 67 on upright wall 26*b* ensures proper alignment of the clamp assembly 52. The bottom rounded projection 54 contacts a rounded recess 65 so as to provide a smooth, rolling motion of the clamp assembly 52 toward the upright wall 26*b* when the set screw 62 is tightened. Additionally, when the set screw 62 is tightened, a cushion 64 on the upright wall 56 is angled toward upright wall 26*b* to contact and securely hold a ski in position. A second transverse projection 69 on the upright wall 26*b* supports a ski as it is inserted in the clamp assembly 52.

Figure 4A:
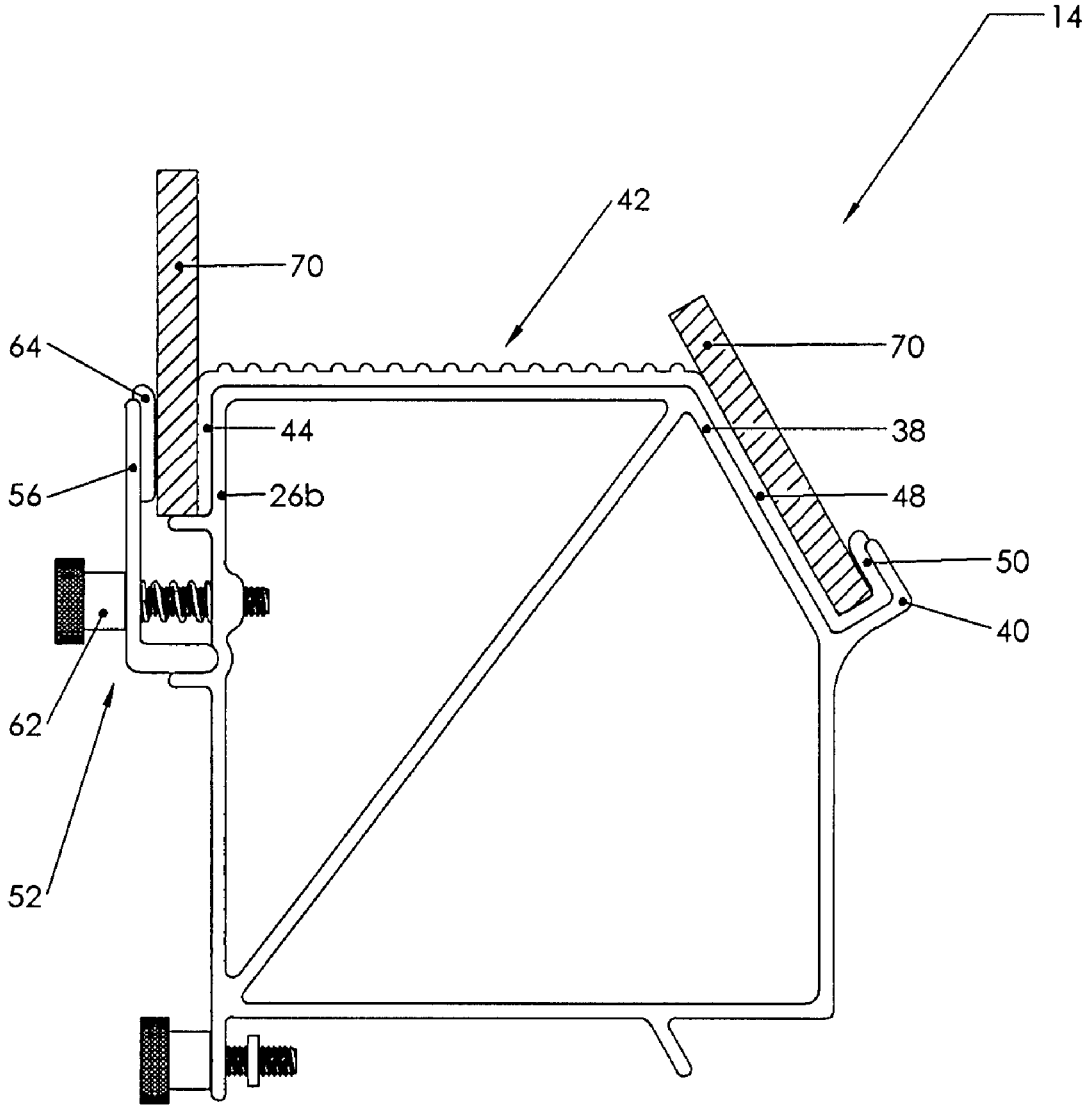
FIGS. 4A-4B are side views of the ski support assembly shown in FIG. 3, showing a ski positioned on the ski support assemblies.
Figure 4B:
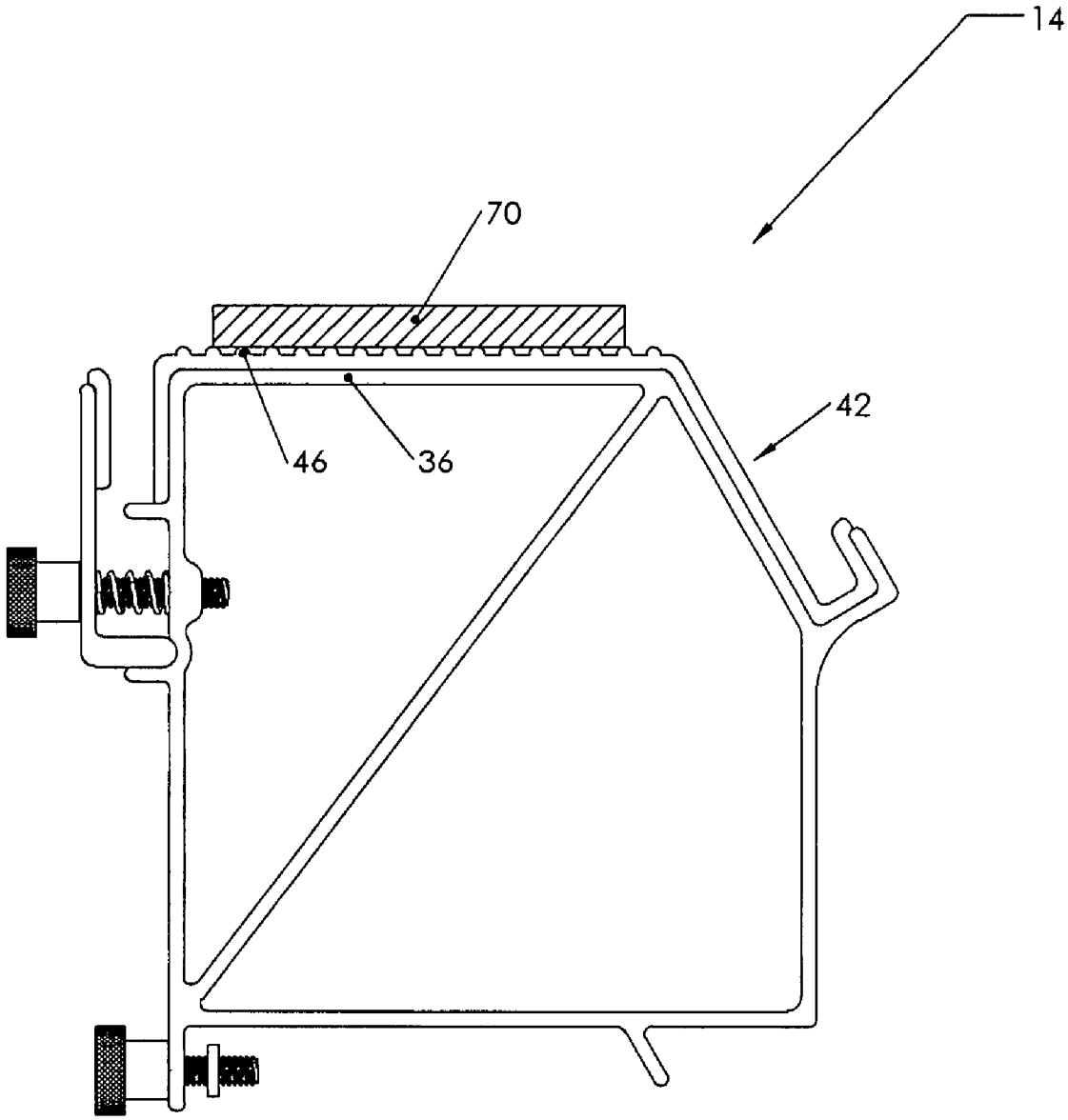

FIGS. 4A-4B are side views of the support assembly 14 showing a ski positioned thereon. As shown in FIG. 4A, a ski 70 could be held by the support assembly 14 in a generally vertical orientation or in an angled orientation (e.g., at 60 degrees to the horizontal plane). In the vertical orientation, the ski 70 is clamped by the clamping assembly 52, wherein the cushion 64 and the upright cushion portion 44 contact opposite sides of the ski 70. When the set screw 62 is tightened by a user, the upright walls 26*b* and 56 exert force against the ski 70, thereby frictionally retaining the ski 70 in a fixed position. In the angled position, an edge of the ski is inserted into and retained by the support finger 40. The angled cushion portion 48 and the cushion finger portion 50 contact the ski 70 and frictionally retain same in a fixed, angled position. The non-slip surfaces provided by the cushion 42 (i.e., cushion portions 44, 48, 46 and), as well as cushion 64, prevent the ski 70 from moving or slipping off of the support assembly 14 during use.

As shown in FIG. 4B, the ski 70 could be positioned horizontally, against the transverse cushion portion 46 of the cushion 42 and the upper transverse wall 36. The portion 46 of the cushion 42 provides a non-slip surface to prevent the ski 70 from moving or slipping off of the support assembly 14 during use. As shown, the cushion 42 could include treads for additional frictional engagement with the ski 70.

Figure 5:
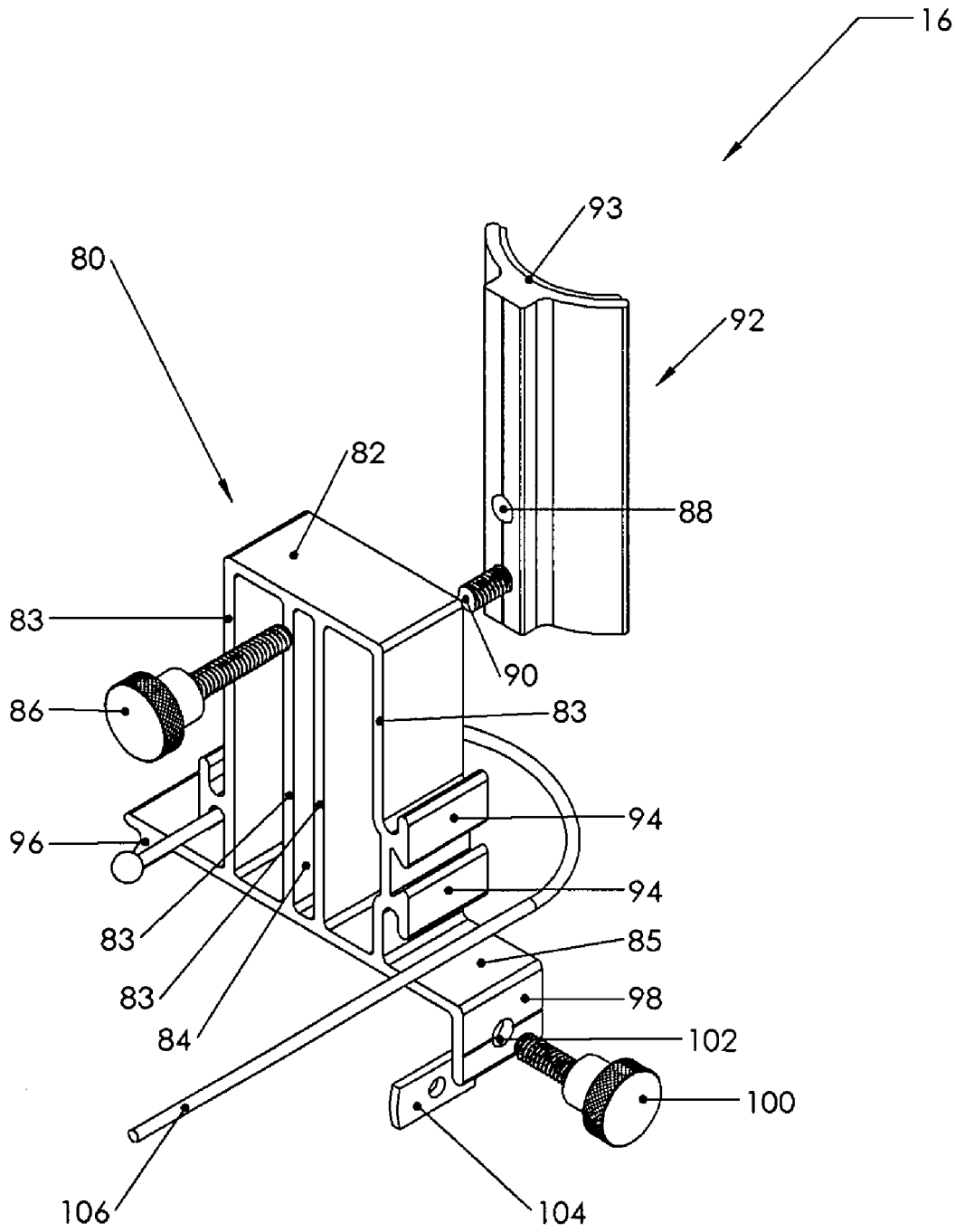
FIG. 5 is an exploded perspective view showing the binding support assembly of the present invention in greater detail.

FIG. 5 is an exploded perspective view of the binding support assembly 16 of the present invention. Each assembly 16 includes a slideable support body 80 and an adjustable contact pad 92. The support body 80 includes an upper transverse wall 82, a plurality of upright walls 83 which define a central slot 84, and a lower transverse wall 85. The slot 84 receives a set screw 86 which is threadably engageable with a threaded aperture 88 formed in the contact pad 92. The slot 84 also receives a threaded guide stud 90 fixedly attached to the adjustable contact pad 92 to ensure generally vertical orientation of the pad 92 with respect to the support body 80. A rope or cord 106 is coupled to the support body 80. The rope 106 can be looped around a binding to secure a ski in position on the ski holder of the present invention. The support body 80 includes side projections 94 which allow one end of the rope 106 to be secured thereto. It should be noted that the sizes and shapes of the projections 94 could be varied as desired without departing from the spirit or scope of the present invention. Further, the rope 106 could be substituted with a strap which could be affixed to the support body 80 using any suitable fasteners, such as hooks, buttons, snaps, hook-and-loop type fasteners, etc.

The lower transverse wall 85 includes a depending track engagement projection 96 and a depending track guide tab 98 which facilitate slideable engagement between the binding support assembly 16 and the track assembly 12. The track engagement projection 96 could be angled with respect to the wall 85, as shown, slides along a corresponding channel formed in the track assembly 12, and is shaped so as to prevent the binding support assembly 16 from detaching from the track assembly 12 when slideably engaged therewith. The tab 98 includes an aperture 102 which receives a set screw 100 that extends into a channel along an edge of the track assembly 12 for selectively locking the binding support assembly 16 in a fixed position along the track assembly 12. A nut 104 positioned within the channel threadably engages the screw 100 and bears against the track assembly 12 when the screw 100 is tightened, so as to retain the binding support assembly 16 in a fixed position. These features work together to limit the relative movement of the binding support assembly 16 with respect to the track assembly 12 during use. As shown, the adjustable contact pad 92 could be concave in shape to accommodate the end of a binding to inhibit lateral movement of a ski. The pad 92 could include a cushioning 93 formed of rubber, plastic, foam, etc., to prevent damage to a ski binding and to inhibit movement of the ski.

Figure 6:
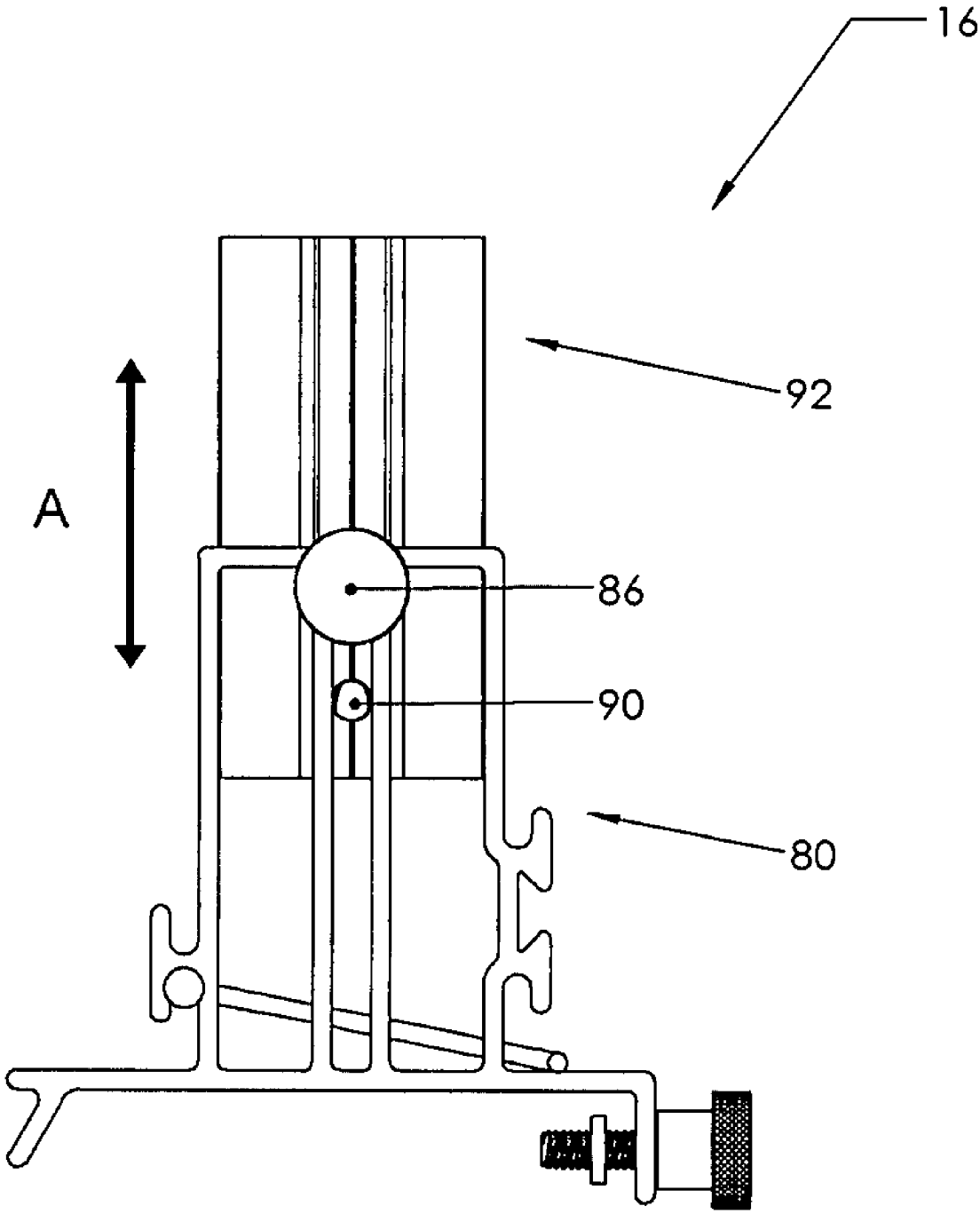
FIG. 6 is a side view of the binding support assembly shown in FIG. 5.

As shown in FIG. 6, the contact pad 92 can slide vertically with respect to the support body 80, as indicated by arrow A. The guide stud 90 ensures that the pad 92 is maintained in a generally vertical orientation. Advantageously, the ability of the support body 80 to slide along the track assembly 12 allows the pad 92 to be contacted against bindings on a ski to further engage the ski to the ski holder of the present invention. When the pad 92 is moved to a desired position, the screw 86 is tightened so that the pad 92 is drawn against the support body 80 to hold the pad 92 in a fixed position. The pad 92 can be moved upwardly with respect to the body 80 so as to contact a ski to support same and to prevent the ski from flexing during tuning.

Figure 7:
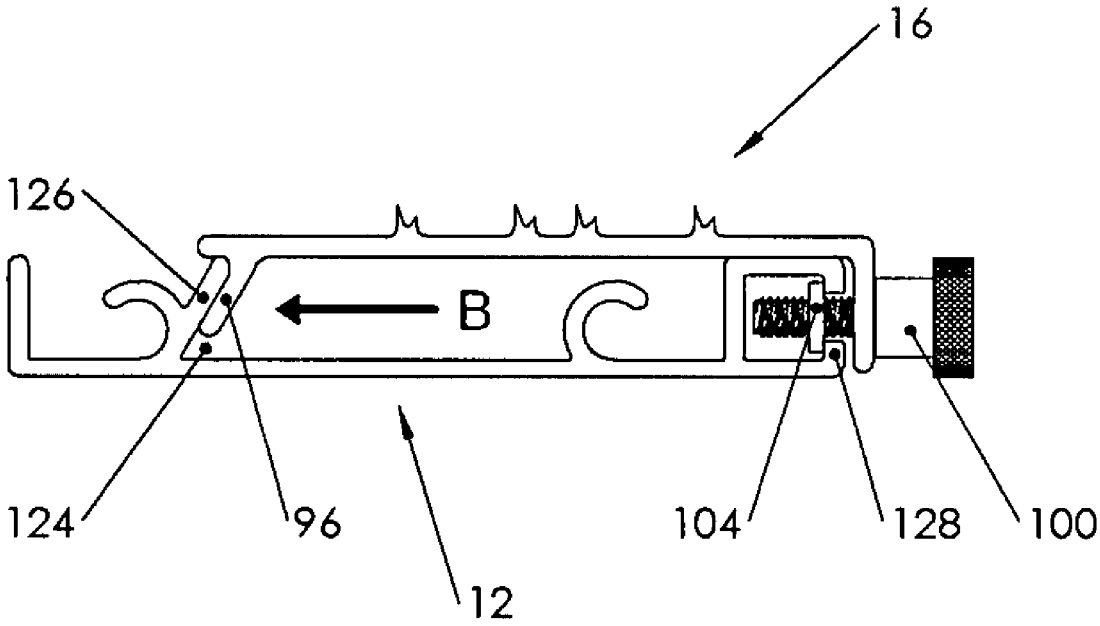
FIG. 7 is a partial side view showing engagement of the binding support assembly with the track assembly of the present invention.

FIG. 7 is a partial side view showing engagement of the binding support assembly 16 with the track assembly 12. It is noted that a similar type of engagement is employed with the ski support assembly 14. The depending track engagement projection 96 slides within a corresponding channel 124 formed in the track assembly 12. When it is desired to lock the binding support assembly 16 in a fixed position, the set screw 100 is tightened by a user. This causes the nut 104 to bear against the side wall 128 of the track assembly 12, which, in turn, urges the projection 96 against an angled side wall 126 of the channel 124 as indicated by arrow B. This causes the support assembly 16 to be held in a fixed position against the track assembly 12. The set screw can be untightened as desired by a user, and the support assembly slid to a new location along the track assembly 12.

It is also noted that a stabilization assembly can be provided for each of the support assemblies 14 and 16 to assist with movement and alignment of the assemblies 14 and 16 along the track assembly 12 and to prevent excessive "chattering" of the assemblies 14 and 16 as they slide along the track assembly 12. Such a stabilization assembly could include a pair of washers formed from an anti-friction material (including, but not limited to, ultra-high molecular weight (UHMW) polyethylene or acetyl resin engineered plastic (e.g., DELRIN brand plastic manufactured by DuPont, Inc.)) and a spring or other bias positioned between the washers to urge them against the channel formed in the track assembly 12 when the set screws 32 and 100 are untightened. The spring and washers can be disposed coaxially about the set screws 32 and 100, and one of the washers positioned on one side of the spring. The opposite side of the spring can contact the nut 34 or 104, and the remaining washer can be positioned between the nut 34 or 104 and the side wall 128 of the channel. As the set screws 32 and 100 are untightened, the spring urges the washers against the sides of the channel so as to allow the support assemblies 14 and 16 to slide along the track assembly 12 while reducing chattering. Of course, different components and/or materials could be implemented without departing from the spirit or scope of the present invention.

Figure 8:
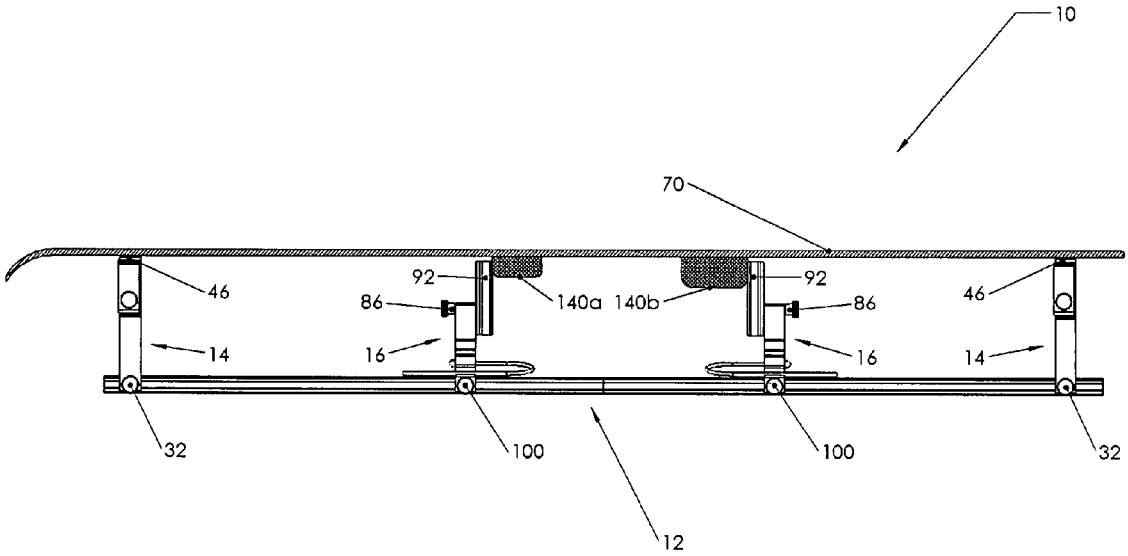
FIG. 8 is a side view showing the ski holder of the present invention engaged with a ski.

FIG. 8 is a side view showing engagement of a ski 70 with the ski holder 10 of the present invention. Prior to placement of the ski 70, the ski support assemblies 14 are positioned at desired locations along the track assembly 12, and are locked into place by tightening the set screws 32. Then, the ski 70 is placed against the cushion portions 46 of the ski support assemblies 14. After placement, the binding support assemblies 16 are moved along the track and toward each other, so that the pads 92 contact bindings 140*a* and 140*b* of the ski 70. When the pads 92 contact the bindings 140*a* and 140*b*, the set screws 100 are tightened to lock the binding support assemblies 16 in place on the track 12. The pads 92 could be adjusted to desired vertical orientations to support the ski and the set screws 86 tightened to lock the pads 92 in place to prevent the ski from flexing as downward pressure is applied. When the support assemblies 14 and 16 are locked in position on the track assembly 12 and the pads 92 contact the bindings 140*a* and 140*b*, the ski 70 is firmly held in place.

Although use of the present invention was discussed herein in connection with Nordic skis, it is noted that the present invention could also be used (as is, or with minor modifications) to tune cross-country skis and snow boards.

Having thus described the invention in detail, it is to be understood that the foregoing description is not intended to limit the spirit or scope thereof. What is desired to be protected is set forth in the following claims.

What is claimed is:

1. A device for holding a ski, comprising:

a track;

first and second ski support assemblies slideably engageable with the track, each of the first and second ski support assemblies having a transverse upper wall for contacting upper surface portions of a ski for supporting the ski in a horizontal position, an angled wall and a support finger for supporting a ski in an angled position, and a transverse projection for supporting a ski in a vertical position;

first and second binding support assemblies slideably engageable with the track for contacting bindings of a ski to retain a ski in a fixed position, the first and second binding support assemblies positioned intermediate the first and second ski support assemblies; and a contact pad on each of the first and second binding support assemblies slidable along a vertical direction and lockable in a desired position, wherein the ski support assemblies and binding support assemblies coact to support a ski in a desired orientation to facilitate tuning of a ski.

2. The device of claim 1, wherein each of the ski support assemblies includes a spring-biased clamp for holding a ski in a vertical position.

3. The device of claim 2, further including a pair of facing cushions positioned along vertical walls of the clamp for contacting the face and bottom of a ski.

4. The device of claim 1, wherein each of the ski support assemblies includes a horizontal surface having a cushion thereon for supporting a ski in a horizontal orientation, and an angled surface having a cushion thereon for supporting a ski in an angled orientation.

5. The device of claim 4, wherein the finger includes a base wall perpendicular to the angled surface and an upstanding wall perpendicular to the angled surface, the finger further including cushioning on the base and upstanding walls for frictionally engaging a ski to hold a ski in an angled orientation.

6. The device of claim 1, wherein each of the ski support assemblies includes a set screw for locking the ski support assembly in a fixed position on the track.

7. The device of claim 1, further comprising a cushion attached to the contact pad for cushioning a binding.

8. The device of claim 7, wherein each of the binding support assemblies comprises a rope for retaining a ski in position against the binding support assembly.

9. The device of claim 8, wherein each of the binding support assemblies further comprises at least one projection to which an end of the rope is securable.

10. The device of claim 1, wherein each of the binding support assemblies comprises a set screw for locking the binding support assembly in a fixed position on the track.

11. The device of claim 1, wherein the track comprises a plurality of track portions interconnected by rods.

12. The device of claim 11, wherein each track portion includes a scale.

13. The device of claim 1, wherein the first and second ski support assemblies and the first and second binding support assemblies each include a stabilization assembly for stabilizing the support assemblies during sliding of the support assemblies along the track.

* * * * *